US007448766B1

(12) United States Patent
Lee

(10) Patent No.: US 7,448,766 B1
(45) Date of Patent: Nov. 11, 2008

(54) SHINING BELT

(76) Inventor: Ching-Hui Lee, No. 4, Turnpike Right Side, Yishan Village, Shrling Township, Huadu District, Guangzhou City, Guangdong Province (CN)

( * ) Notice: Subject to any disclaimer, the term of this patent is extended or adjusted under 35 U.S.C. 154(b) by 0 days.

(21) Appl. No.: 11/861,795

(22) Filed: Sep. 26, 2007

(51) Int. Cl.
*F21V 21/08* (2006.01)

(52) U.S. Cl. ..... 362/103; 362/108; 362/234

(58) Field of Classification Search ..... 362/84, 362/103, 105, 106, 108, 200, 234, 251, 800; 2/338, 322; 24/31 R, 32, 68 E, 163 R, 164, 24/182, 578.15
See application file for complete search history.

(56) References Cited

U.S. PATENT DOCUMENTS 5,515,247 A * 5/1996 Cheung et al. ..... 362/84
5,632,549 A * 5/1997 Fang ..... 362/103
5,664,874 A * 9/1997 Winterer ..... 362/200
6,193,385 B1 * 2/2001 Maki et al. ..... 362/108

* cited by examiner

*Primary Examiner*—Y My Quach Lee
(74) *Attorney, Agent, or Firm*—Rosenberg, Klein & Lee

(57) ABSTRACT

A belt includes a main part, a buckle securely joined to one end of the main part, a power controlling device in the buckle, and light emitting members on the main part; the power controlling device includes a circuit board, an IC component, a poked switch, a button switch, and a battery module; the circuit board is electrically connected to the light emitting members on the main part; the IC component, the poked switch, the button switch, and the battery module are connected to the circuit board; the battery module includes a battery holding member, and batteries held on the battery holding member; the battery holding member can be drawn out of the buckle for battery change; the user can change brightness of the light emitting members, and the way and frequency of the light emitting members flashing on and off by means of pressing the button switch.

5 Claims, 5 Drawing Sheets

SHINING BELT

BACKGROUND OF THE INVENTION

1. Field of the Invention

The present invention relates to a shining belt, more particularly one, which is worn around a person's waist, and can shine to help other people such as drivers to notice the wearer easily when the wearer is walking or working on the road in the night.

2. Brief Description of the Prior Art

Traffic policemen, members of cleaning teams, and road construction workers are among those people who have to work on the road in the night. And, there are more people who like to take part in recreational activities in the night after they come off work.

Car drivers would drive at a higher speed in the night because there are fewer pedestrians and cars on the road. Consequently, traffic policemen, members of cleaning teams, and road construction workers are exposed to more danger of being run into by cars than other people. Moreover, owing to the dim light in the night, traffic accidents are more likely to happen. To overcome the above problems, the industry developed reflective clothing, belts, and armbands, which can reflect light of cars to make the drivers notice the wearers easily so as to avoid traffic accidents.

However, the above-mentioned reflective clothing, belts, and armbands have their drawbacks: they can't help car drivers notice the wearers if the headlights of the cars aren't turned on; it is possible for the reflective clothing, belts, and armbands not to make light travel back to the cars directly when the wearers are in certain positions. Consequently, the reflective clothing, belts, and armbands still can't help car drivers notice the wearers, and the wearers are still exposed to danger of being run into in the night.

SUMMARY OF THE INVENTION

It is a main object of the present invention to provide a shining belt to serve to help other people such as car drivers to notice the wearer when the wearer is walking or working on the road in the night, thus helping to avoid traffic accidents.

A belt according to an embodiment of the present invention includes a main part, a buckle securely joined to one end of the main part, a power controlling device in the buckle, and light emitting members fitted on the main part. The power controlling device includes a circuit board, an IC component, a poked switch, a button switch, and a battery module, which are all connected to the circuit board. The circuit board is electrically connected to the light emitting members on the main part. The battery module includes a battery holding member, and batteries held on the battery holding member. The wearer can change brightness of the light emitting members, and the way and frequency of the light emitting members flashing on and off by means of pressing the button switch.

Furthermore, the battery holding member can be drawn out of the buckle for battery change. Therefore, to change batteries, the user only has to draw the battery holding member out of the buckle first if he/she wants to change batteries, not having to take the buckle apart.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
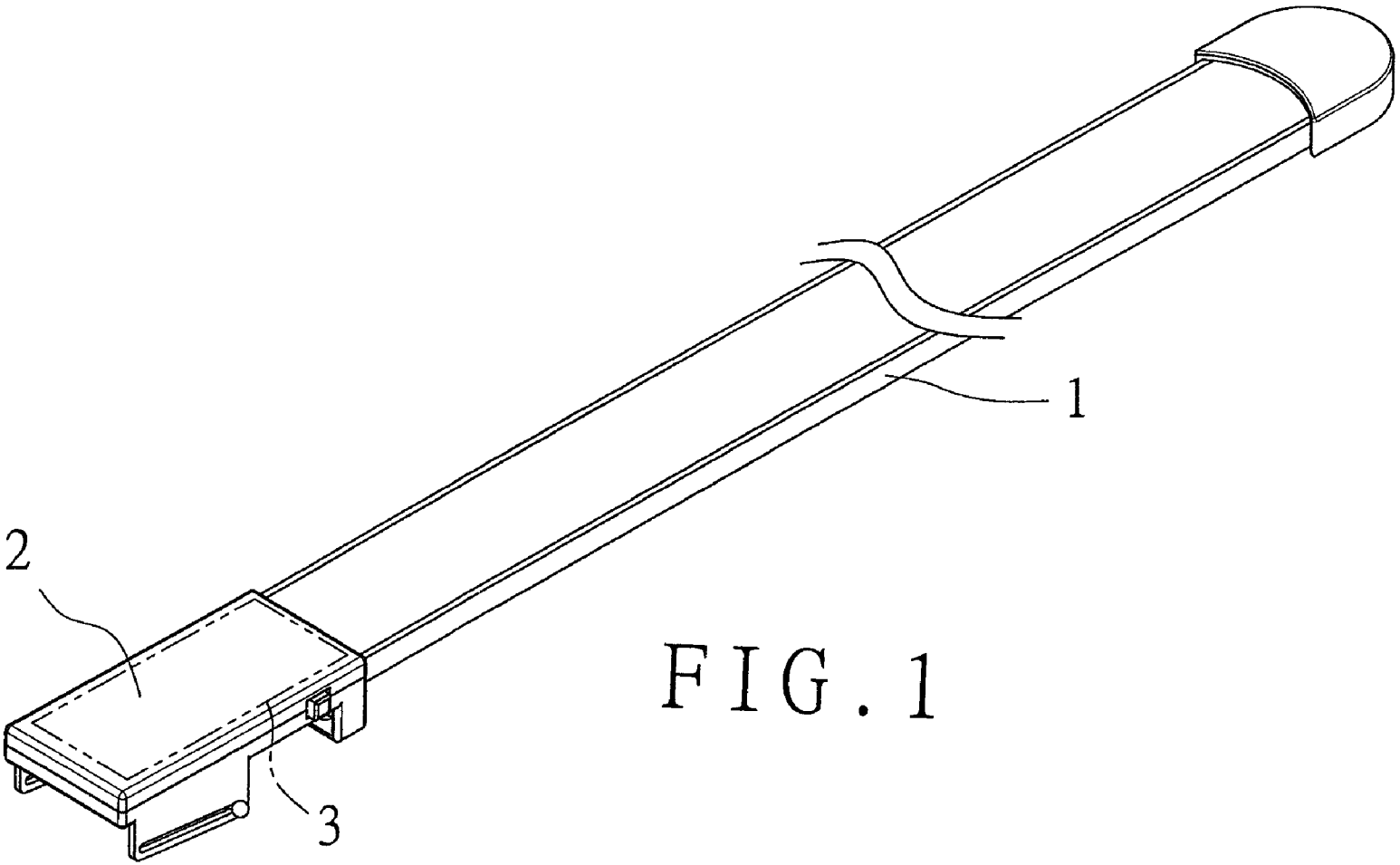
FIG. 1 is a perspective view of the present invention.
Figure 2:
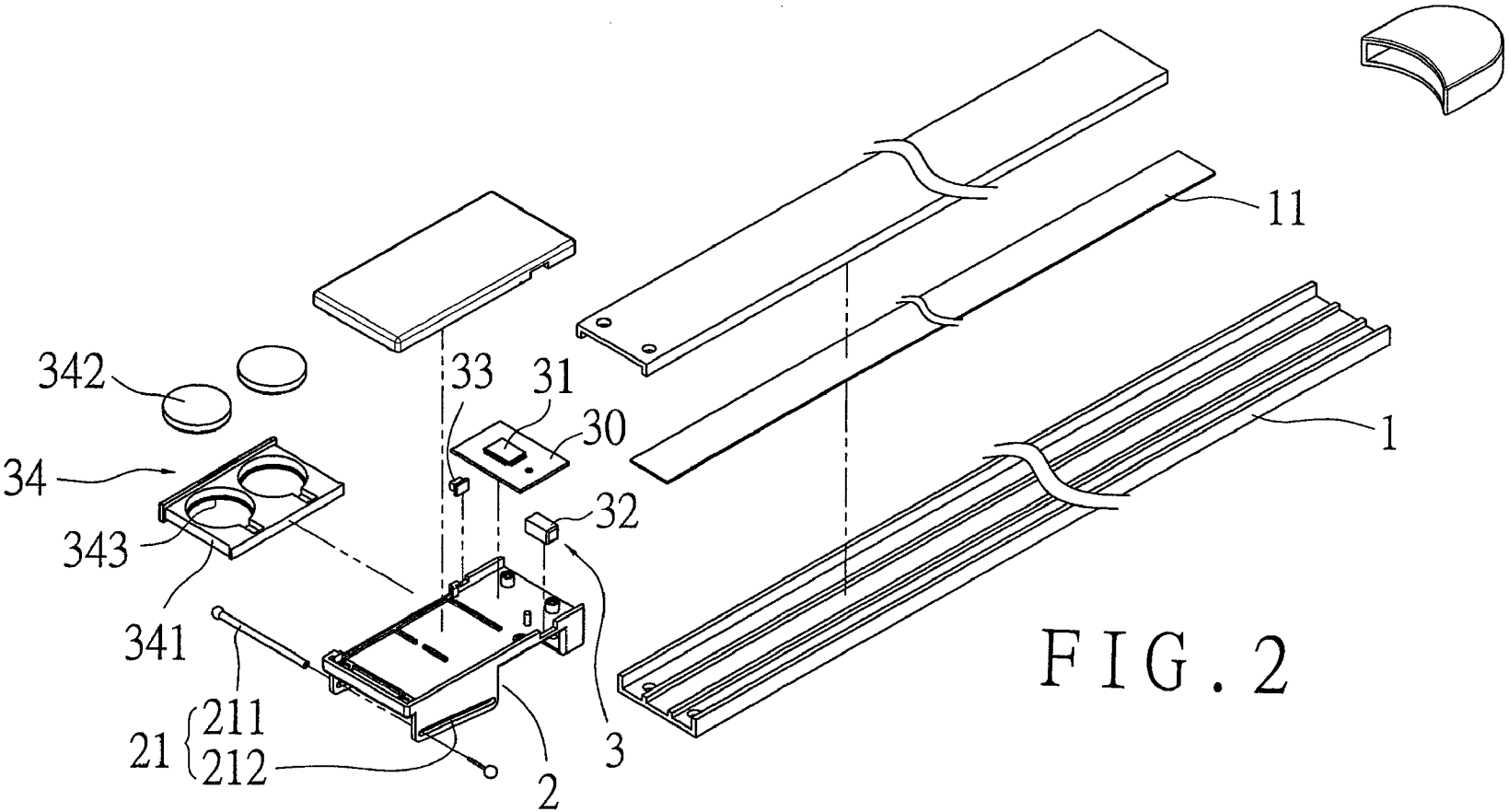
FIG. 2 is an exploded perspective view of the present invention.

Referring to FIGS. 1 and 2, a preferred embodiment of a shining belt of the present invention includes a main part 1, a buckle 2, and a power controlling device 3.

The main part 1 of the belt is a transparent, and has several light emitting members 11 fitted thereon. The light emitting members 11 can be light emitting diodes (LED) or electroluminescent (EL) components.

The buckle 2 is securely joined to one end of the main part 1 of the shining belt. The buckle 2 is equipped with a fastening device 21 on a lower portion thereof. The fastening device 21 includes a stick part 211, and sloping guide slots 212 formed on two lateral sides of the buckle 2; the stick part 211 is passed through the sloping guide slots 212.

Figure 3:
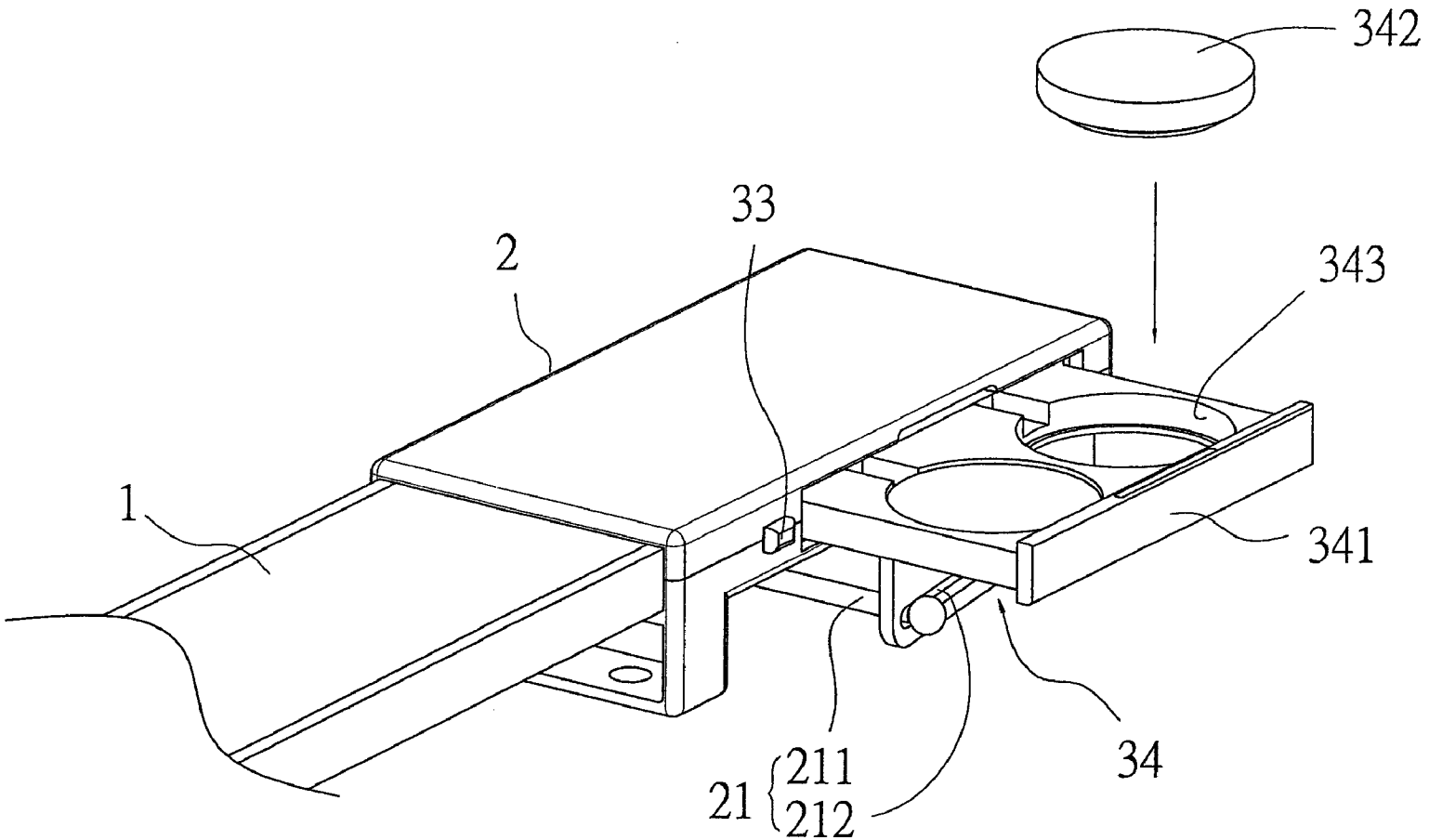
FIG. 3 is a partial perspective view of the present invention.
Figure 4:
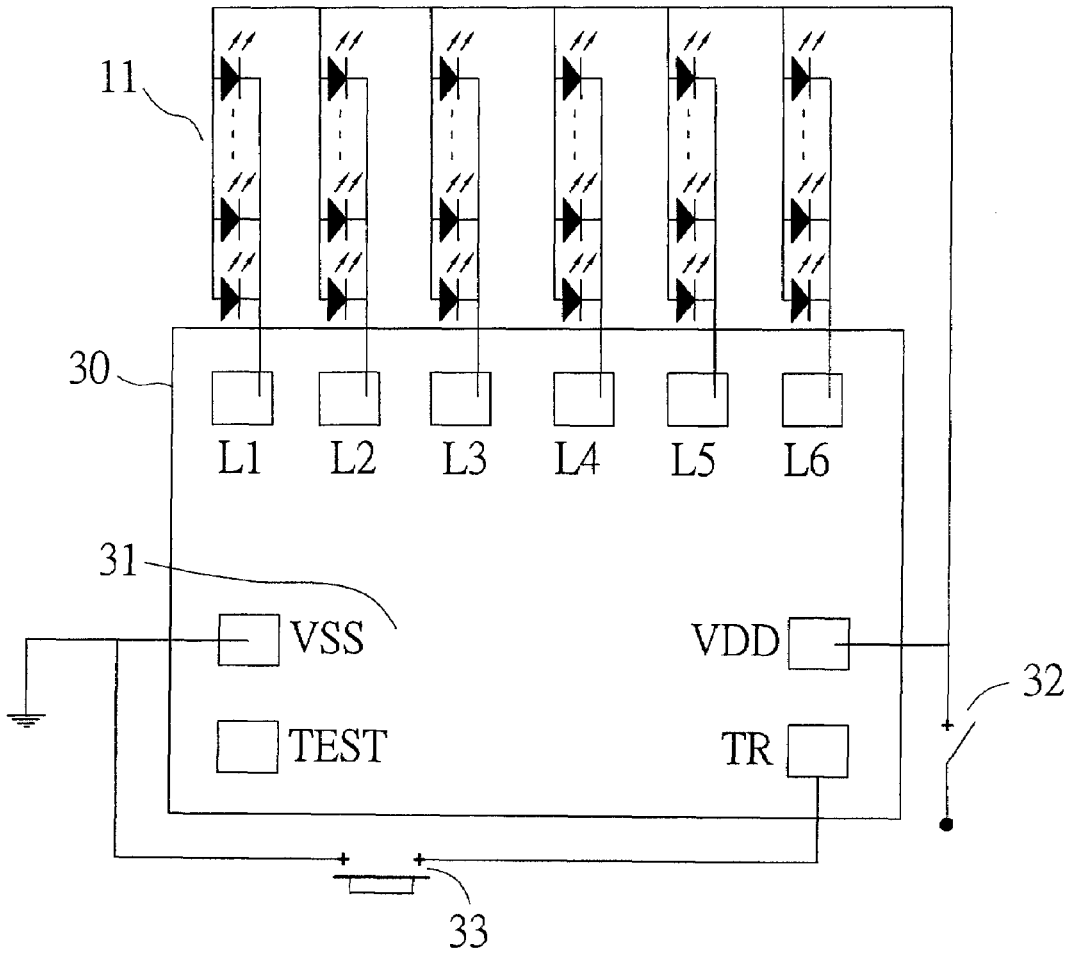
FIG. 4 is a circuit diagram of the present invention.

The power controlling device 3 is positioned in the buckle 2. Referring to FIG. 4 as well, the power controlling device 3 includes a circuit board 30, an IC component 31 connected to the circuit board 30, a poked switch 32 connected to the circuit board 30, a button switch 33 connected to the circuit board 30, and a battery module 34 connected to the circuit board 30. The circuit board 30 is connected to the light emitting members 11 of the main part 1 of the belt. The battery module 34 includes a battery holding member 341, and several batteries 342 held on the battery holding member 341 to provide power to the circuit board 30, the IC component 31, and the light emitting members 11. The battery holding member 341 can be drawn out of the buckle 2, and has several holding cavities 343 to receive the batteries 342, as shown in FIG. 3.

Figure 5:
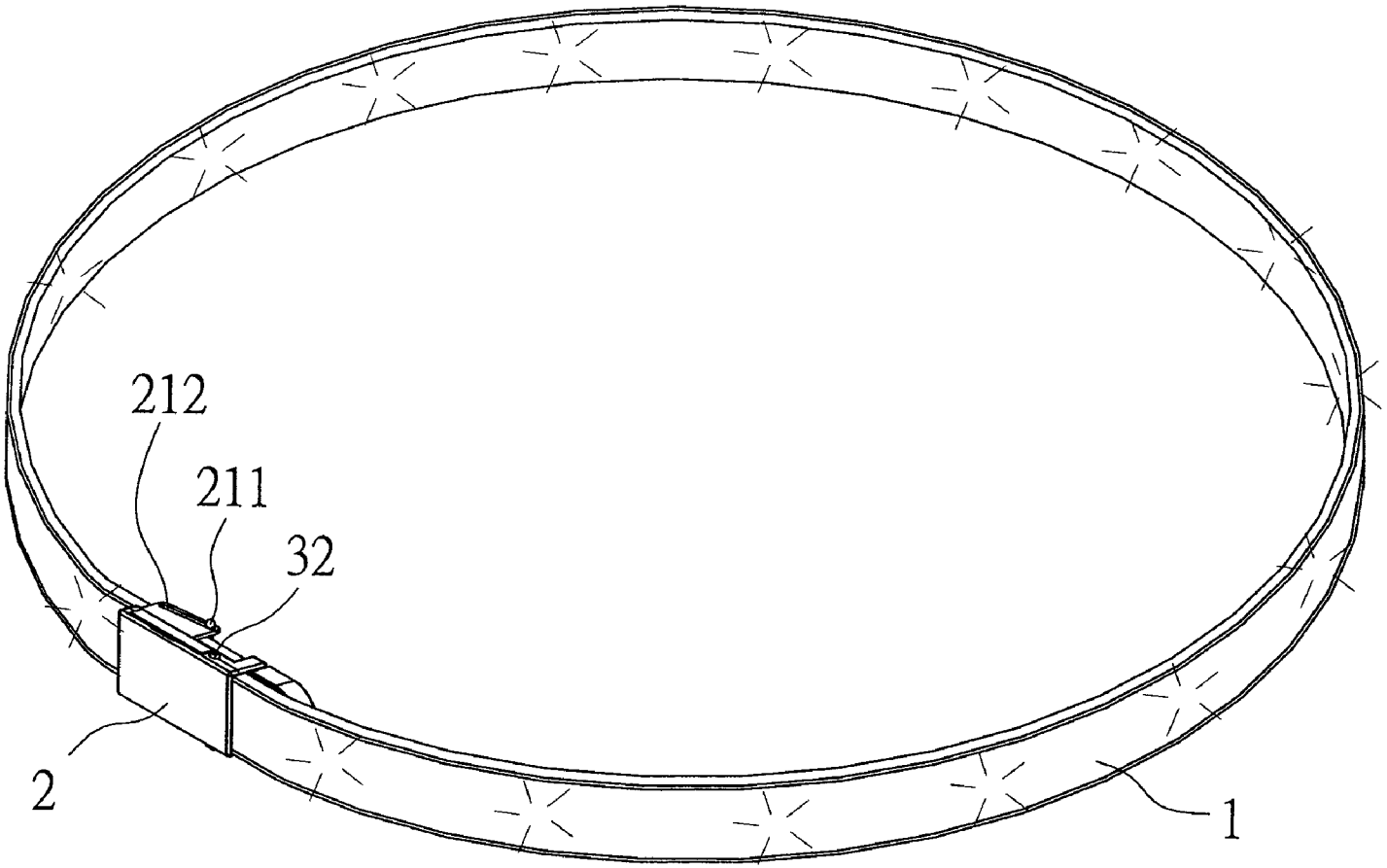
FIG. 5 is a perspective view of the present invention being in use.

In use, referring to FIG. 5, a person puts the shining belt around his/her waist, and passes the other end of the main part 1 of the shining belt through a space between a bottom side of the buckle 2 and the stick part 211, and moves the stick part 211 from lower end portions of the sloping guide slots 212 to upper end portions of the sloping guide slots 212; thus, the main part 1 is firm around the wearer's waist.

Next, the wearer pokes the poked switch 32 such that power is turned on, and the circuit board 30, the IC component 31, the button switch 33, and the light emitting members 11 together comprise a closed circuit. Consequently, the light emitting members 11 are powered to emit light so as to make other people such as car drivers notice, thus preventing traffic accidents.

Furthermore, the wearer can change the brightness of the light emitting members 11, and the way and frequency of the light emitting members 11 flashing on and off by means of pressing the button switch 33 to control the IC component 31. Consequently, light emitted from the light emitting members 11 will be more attractive, and make other people notice the wearer even more easily in the night.

From the above description, it can be seen that the present invention has the following advantages:

1. The shining belt will emit light to make other people notice the wearer easily in the night. Therefore, car drivers will notice the wearer easily to avoid traffic accidents when the wearer is walking or working on the road in the night.

2. The wearer is allowed to change the brightness of the light emitting members of the shining belt, and the way and frequency, in which the light emitting members flash on and off, by means of pressing the button switch to control the IC component. Consequently, light emitted from the light emitting members will make other people notice the wearer even more easily in the night. And, the shining belt will be very attractive, and help to produce dazzling effects when the wearer is taking part in a dance with dim lamplight.

3. The shining belt of the present invention is relatively convenient to use; the user only has to draw the battery holding member out of the buckle first if he/she wants to change batteries, not having to take the buckle apart.

4. The shining belt is equipped with a fastening device, which is easy to use. The fastening device includes sloping guide slots on two sides of the buckle, and a stick part passed through the sloping guide slots; to fasten the shining belt around the user's waist, the user only has to pass the main part of the shining belt through a space between a bottom side of the buckle and the stick part, and moves the stick part from lower end portions of the sloping guide slots to upper end portions of the sloping guide slots.

What is claimed is:

1. A shining belt, comprising:

a main part, the main part having a plurality of light emitting members thereon;

a buckle securely joined to one end of the main part, the buckle including a pair of sloping guide slots formed in laterally opposed sides thereof and a stick part coupled to extend laterally between the sloping guide slots, the stick tart being displaceable within the sloping guide slots responsive to passage of an end of the main part through said buckle;

a power controlling device positioned in the buckle, the power controlling device including a circuit board, an IC component, a poked switch, a button switch, and a battery module;

the circuit board being connected to the light emitting members;

the IC component, the poked switch, the button switch, and the battery module being connected to the circuit board;

the battery module including a battery holding member, and a plurality of batteries; the battery holding member being capable of being drawn out of the buckle; the battery holding member having a plurality of holding cavities, in which the batteries are received;

wherein one of the poked and button switches is actuable to energize the IC component and the other is actuable to selectively adjust the light emitted by the light emitting members.

2. The shining belt as claimed in claim 1, wherein the buckle is equipped with a fastening device on a lower portion thereof; the fastening device including the sloping guide slots on two sides of the buckle, and the stick part passed through the sloping guide slots, the stick part and an upper portion of the buckle cooperatively defining a captive opening for receiving the end of the main part therethrough.

3. The shining belt as claimed in claim 1, wherein the light emitting members are light emitting diodes.

4. The shining belt as claimed in claim 1, wherein the light emitting members are electroluminescent (EL) components.

5. The shining belt as claimed in claim 1, wherein the battery holding member forms a tray-like support for the plurality of batteries, the holding member being laterally extendable from a side of the buckle.

* * * * *